United States Patent [19]

Ooms

[11] Patent Number: 4,658,180

[45] Date of Patent: Apr. 14, 1987

[54] FLAMENT SUPPORT FOR A PROJECTION LAMP

[75] Inventor: Leo F. M. Ooms, Eindhoven, Netherlands

[73] Assignee: U.S. Philips Corporation, New York, N.Y.

[21] Appl. No.: 695,986

[22] Filed: Jan. 29, 1985

[30] Foreign Application Priority Data

Feb. 14, 1984 [NL] Netherlands ..... 8400464

[51] Int. Cl.[4] ..... H01J 1/88; H01J 19/42; H01K 1/18

[52] U.S. Cl. ..... 313/273; 313/278

[58] Field of Search ..... 313/273, 278

[56] References Cited

U.S. PATENT DOCUMENTS 3,543,962 12/1970 Peterson ..... 313/273
3,870,920 3/1975 DeFraeye et al. ..... 313/273
4,023,060 5/1977 Pike et al. ..... 313/273
4,145,630 3/1979 DeCaro et al. ..... 313/273
4,367,428 1/1983 Notelteirs et al. ..... 313/222

*Primary Examiner*—Saxfield Chatmon
*Attorney, Agent, or Firm*—David R. Treacy

[57] ABSTRACT

The sections of the filament of a projection lamp are stretched over two sets of supports anchored in glass beams which are fixed on the rigid current supply conductors to form a frame. The supports each consist of a wire having a hooked end which engages the filament between a respective pair of adjacent sections. The supports of at least one set each have an end portion extending transverse to the main link of the support. Each end portion is located at the same given distance from the bend of the hook, and preferably extends from a free end of the hook. This permits each section to be under the same tension.

2 Claims, 2 Drawing Figures

FLAMENT SUPPORT FOR A PROJECTION LAMP

BACKGROUND OF THE INVENTION

The invention relates to a line-voltage-operated incandescent lamp having a translucent lamp vessel sealed in a vacuum-tight manner;

current supply conductors entering through the wall of the lamp vessel and mechanically interconnected inside the lamp vessel by means of glass beams with which they constitute a frame;

a filament comprising several helically wound sections which are stretched at least substantially parallel to each other in the frame, each end of the filament being electrically connected to a respective current supply conductor; and two sets of supports which are anchored in a respective glass beam of the frame. Each support consists of a wire terminating in a hook and each hook engages the filament between a respective pair of adjacent sections of the filament.

Such a lamp is known from British Patent Specification 2,069,233 to which U.S. Pat. No. 4,367,428 corresponds.

The known lamp has a frame of a rigid construction, as a result of which the lamp is capable of withstanding shocks. In this respect, the known lamp is superior to lamps which were previously commercially available, in which two tungsten wires are anchored each with one end in one of the glass beams of the frame, while the other end of these wires is helically wound and grips around a respective current supply conductor and is fixed thereto. In these commercially available lamps, the length of the frame and hence the stress in the filament can be readily adjusted by slipping the helically wound ends further or less far over the current conductors, but the frame is not very capable of withstanding shocks.

In the manufacture of the lamp according to the that British Patent Specification, it has proved to be difficult to mount the filament with the correct tension in all its sections.

SUMMARY OF THE INVENTION

The object of the invention is to provide a lamp construction which permits a simple method of manufacturing the lamp.

According to the invention, in a lamp as described in the first paragraph above, the supports of at least one set each have an end portion extending in a direction which is transverse to the main length of the respective support and is located at a given distance from the peak of the bend of the hook. This given distance is the same for each support of the set.

In a preferred embodiment, a lamp according to the invention has a lamp vessel of a glass having a high $SiO_2$ content, for example, of at least 95% by weight, such as quartz glass, while the glass beams are also made of such a glass and the lamp vessel is filled with a mixture of a halogen or a halogen-containing gas together with nitrogen or a rare gas. The filament is monoplanar (that is, its sections are situated in one flat plane,) or biplanar (that is, its sections are situated alternately in a first flat plane and in a second flat plane parallel thereto). The lamp may be used, for example, for illumination in film studios or in theatres or as a projection lamp.

BRIEF DESCRIPTION OF THE DRAWING

An embodiment of a lamp according to the invention is shown in the drawing in front elevation (FIG. 1) and in side elevation (FIG. 2).

DESCRIPTION OF THE PREFERRED EMBODIMENT

Figure 1:
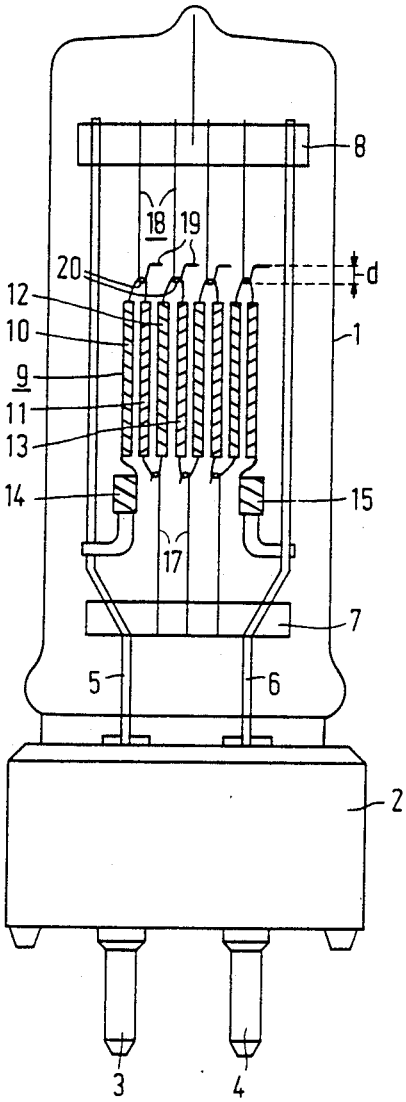

A quartz glass lamp vessel 1 sealed in a vacuum-tight manner is fixed in a lamp cap 2 provided with external contacts 3,4. Current supply conductors 5,6 enter through the wall of the lamp vessel 1 and are mechanically interconnected inside the lamp vessel 1 by means of quartz glass beams 7 and 8 with which they constitute a frame 5–8. The current supply conductors 5,6 are electrically connected to the external contacts 3 and 4, respectively.

A filament 9, provided with several helically wound sections 10–13 which are stretched substantially parallel to each other in the frame 5–8, is connected at its ends 14,15 to the current supply conductor 5 and 6, respectively. A first set of supports 17 is anchored in the quartz glass beam 7, while a second set of supports 18 is anchored in the beam 8. The supports 17,18 each consist of a tungsten wire bent to form a hook, each hook engaging the filament with its bend 20 between a respective pair of adjacent sections 11,12, 10, 11 and 12,13, The longitudinal axes of the sections 10,12 are located in a first flat plane, while the longitudinal axes of the sections 11,13 are located in a second flat plane.

In the lamp shown, the hooks of the supports 18 each have an end portion 19 extending from the free end of the hook in a direction which is transversely to the main length of the support 18 and is located at a given distance d from the peak of the bend 20 of the hook. In the embodiment shown, this transversely projecting end portion 19 is located near the re-entrant bend 20, but this end portion 19 could have been located near the other end of the support 18. Furthermore, it is also possible to provide each of the supports 17 with such an end portion.

Figure 2:
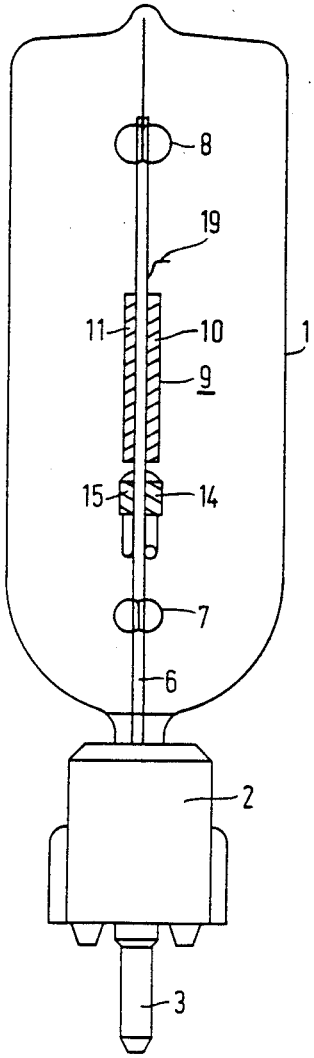

In the manufacture of the lamp, a semimanufactured article is obtained which consists of the current-supply conductors 5 and 6 interconnected by the beam 7 in which the supports 17 are anchored, which are to hook around the filament 9. The beam 8 and the supports 18 are still to be provided. The sections 10–13 have to be mounted so as to be stretched from their initial state with the same tension. The beams 7 and 8 are each composed of two overlapping parts, as appears from FIG. 2. When the beams are formed, the parts of a beam softened by heating are compressed with the interposition of the metal supports which have to be incorporated in the beam. In order to obtain the correct tension in the sections of the filament, it is of major importance that the supports are incorporated and anchored in the beam in the correct position. In the manufacture of the semi-manufactured article 5,6,7,17 it is rather easy to embed the support in a correct position into the beam 7 by using a jig. After the filament 9 has been mounted to said the semi-manufactured article, the hooks 17 engaging the filament between respective pairs of sections of the filament, it is very difficult to apply the other beam and the second set of supports engaging the filament while providing the correct tension in the filament sections, when the second set of supports are of the previously used shape. The transversely projecting end portions 19 of the supports 18 make it possible, however, to hold these supports in a defined manner and hence to give the sections 10–13 the correct tension when the frame 5–8 is completed by providing the glass beam 8 and securing the beam 8 to the conductors 5 and 6.

The lamp shown is a 240 V, 650 W theatre lamp having a gas filling consisting of a mixture of HBr and nitrogen containing 0.2% by volume of HBr. The lamp vessel is fixed in the lamp cap by means of a layer of cement, which is applied on top of finely divided alumina, which fills the space between the lamp vessel and the walls of the lamp cap.

What is claimed is:

1. An incandescent lamp comprising a translucent lamp vessel sealed in a vacuum-tight manner, a frame, comprising two current supply conductors entering through the wall of the lamp vessel, and two glass beams inside the lamp vessel, said beams mechanically interconnecting said conductors, a filament having several helically wound sections which are stretched at least substantially parallel to each other in the frame, each end of said filament being electrically connected to a respective current supply conductor, and two sets of supports, each anchored in a respective glass beam of the frame, said supports each consisting of a wire having a main link and terminating in a hook, each hook having a bend having a peak, and a free end; and each hook engaging the filament between a respective pair of adjacent sections of the filament, characterized in that the supports of at least one set each have an end portion extending in a direction which is transverse to said main length of the respective support, and is located at a given distance from said peak of the bend of the hook of the respective support, said given distance being the same for each support of the set.

2. An incandescent lamp comprising a translucent lamp vessel sealed in a vacuum-tight manner, a frame, comprising two current supply conductors entering through the wall of the lamp vessel, and two glass beams inside the lamp vessel, said beams mechanically interconnecting said conductors, a filament having several helically wound sections which are stretched at least substantially parallel to each other in the frame, each end of said filament being electrically connected to a respective current supply conductor, and two sets of supports, each anchored in a respective glass beam of the frame, said supports each consisting of a wire having a main link and terminating in a hook, each hook having a bend having a peak, and a free end; and each hook engaging the filament between a respective pair of adjacent sections of the filament, characterized in that the supports of at least one set each have an end portion extending from the respective hook free end in a direction which is transverse to said main length of the respective support, and is located at a given distance from said peak of the bend of the hook of the respective support, said given distance being the same for each support of the set.

* * * * *